US005776313A

United States Patent [19]

Bakis et al.

[11] Patent Number: 5,776,313

[45] Date of Patent: Jul. 7, 1998

[54] PAPERMACHINE CLOTHING OF ALIPHATIC POLYKETONES

[75] Inventors: George Bakis, West Roxbury, Mass.; John Edmond Flood, Houston, Tex.

[73] Assignee: Shell Oil Company, Houston, Tex.

[21] Appl. No.: 795,010

[22] Filed: Feb. 5, 1997

Related U.S. Application Data

[60] Provisional application No. 60/011,121 Feb. 5, 1996.

[51] Int. Cl.[6] ..... D21F 3/00

[52] U.S. Cl. ..... 162/358.2; 162/900; 162/902; 162/903; 132/420 R; 132/383 A

[58] Field of Search ..... 139/420 R, 383 A; 162/358.2, 900, 902, 903

[56] References Cited

U.S. PATENT DOCUMENTS

| | | | |
|---|---|---|---|
| 5,104,724 | 4/1992 | Hsu . | |
| 5,137,601 | 8/1992 | Hsu . | |
| 5,169,499 | 12/1992 | Eagles et al. . | |
| 5,194,121 | 3/1993 | Taguchi et al. . | |
| 5,194,210 | 3/1993 | Lommerts et al. | 264/184 |
| 5,200,260 | 4/1993 | Hsu . | |
| 5,234,644 | 8/1993 | Schutze et al. . | |
| 5,297,590 | 3/1994 | Fleischer . | |
| 5,316,833 | 5/1994 | Davis et al. . | |
| 5,340,909 | 8/1994 | Doerr et al. . | |
| 5,360,660 | 11/1994 | Nohlgren . | |
| 5,407,736 | 4/1995 | McKeon . | |
| 5,424,125 | 6/1995 | Ballard et al. . | |
| 5,444,113 | 8/1995 | Sinclair et al. . | |
| 5,474,522 | 12/1995 | Scholz et al. . | |
| 5,479,952 | 1/1996 | Zachariades et al. . | |

OTHER PUBLICATIONS

Reserch Disclosure, Dec. 1995 No. 380 pp. 1–4.

*Primary Examiner*—Christopher Raimund
*Attorney, Agent, or Firm*—Todd F. Volyn

[57] ABSTRACT

Continuous belts used on paper making machines are made of alternating aliphatic polyketones. The belts have excellent dimensional stability, are hydrolytically stable, and have good resistance to abrasive wear.

16 Claims, No Drawings

PAPERMACHINE CLOTHING OF ALIPHATIC POLYKETONES

FIELD OF THE INVENTION

This application claims the benefit of the filing of U.S. Provisional Patent Application 60/011,121 filed on Feb. 5, 1996. This invention relates to papermachine clothing suitable for use in the forming, pressing, or drying sections of a paper making machine. More particularly, it relates to such fabrics made from monofilament of synthetic polymer resins, specifically, alternating aliphatic polyketones.

BACKGROUND OF THE INVENTION

In the papermaking process, fabrics used to dewater the paper web undergo severe environmental stresses, i.e., changes in temperature, pressure, humidity and other conditions. Despite these changes, the fabrics must retain compaction resistance, resiliency, wear resistance, dimensional stability and ability to uniformly distribute pressure. Various fabrics have been developed to meet these demands, however none have been found to be completely satisfactory.

The modem papermaker employs a highly sophisticated papermaking machine which is in essence a device for removing water from paper furnish. The water is removed sequentially in the three stages or sections of the machine. In the first or forming section, the furnish is deposited on a moving forming fabric and water is drained through the wire with the aid of water extraction devices such as table rolls, drainage foils, and suction boxes to leave a paper sheet or web having a solids content of about 18 to 25 percent by weight.

The formed web is carried into a press fabric section and passed through one or more nip presses comprised of pairs of rollers on a moving press fabric to remove sufficient water to form a sheet having a solids content of about 36 to 50 percent by weight. The press fabric is ordinarily comprised of a base layer of synthetic or natural fibers to which a batt layer has been needled. Forming fabrics may be woven of synthetic yarns in simple or very complex weaves, usually in one or more layers. The fabrics may be woven of multifilament or monofilament synthetic strands or multilayer structures. The fabrics must provide support for the forming paper sheet and provide adequate and uniform drainage.

The sheet is then transferred to the dryer section of the papermaking machine where dryer fabrics hold the paper sheet against hot, steam-heated dryer cylinders over which the paper sheet passes in serpentine fashion to obtain 92 to 96 percent solids content.

On papermaking machines, endless belts are employed in the various sections to carry the sheet or web of paper. There are a wide variety of forms of the endless belts, some fabricated from metal and others from textile material such as cotton, cotton asbestos, asbestos and synthetic fibrous or filamentous materials. The selection of a given material is dependent to some degree upon the use of the use to which the fabric will be put, i.e., as a forming fabric, press felt, dryer fabric, etc.

One form of a belt which has been used extensively as a forming fabric in the forming section of the papermaking machine is one fabricated from an open weave of synthetic, polymeric resin monofilaments. Such fabrics generally perform well in the forming section although there are certain limitations. For example, the relatively open weaves, particularly when run at the highest speeds, lack dimensional stability. This shortens the overall life of the forming wire which is subject to abrasion as it shifts in position on the machine. In addition, the relatively open weaves are less than fully supportive of the furnish fibers deposited on the wire. Ideally, the fiber and sheet supporting properties of a wire should be increased without significant decrease of water removal through drainage.

Press fabrics operate in the press section of the paper making machine. In this section, the paper sheet is transported by the press fabric and the sheet and fabric are pressed between the nip of the press rolls, which exerts enormous pressure on the sheet and fabric, thereby dewatering the sheet by pressing out the liquid. Also, temperatures in this section of the machine are relatively high. The press fabric generally consists of a base layer and a batt layer of staple fibers needled to the base. Synthetic materials have become the norm, with polyamide being a particularly favored material.

The fabric in the drying section of the machine together with its sheet of paper tends to be subjected to elevated temperatures in a rigorous chemical environment. Dryer fabrics may be woven of synthetic yarns in simple or very complex weaves, usually in more or more layers. Dryer fabrics or dryer screens employed in the paper making industry have traditionally been formed from a variety of materials such as poly(ethylene terephthalate), polyphenylene sulfide and polypropylene. Each material has different properties and pricing. An important property for any material used as a dryer screen in a paper making machine is that the material should have good hydrolytic stability and good dimensional stability.

Paper industry process belts are impermeable belts made in the paper making industry. Paper industry process belts could be needled but they need not be. These belts are comprised of a woven base fabric which is treated with a coating such as polyurethane. Exemplary of paper industry process belts is the shoe press belt used in a shoe press section consisting of a roll and shoe which comprises a paper sheet between the shoe press belt over a considerably longer nip length than can be achieved by nipping between two rolls. The belt is run over the shoe, isolating the fabrics and paper sheet from the oily shoe. This arrangement reduces fabric wear and sheet damage by supporting the fabrics and sheet as they are carried into the nip section. Dimensional stability, resistance to compression, impact resistance and flexibility are all important considerations for this kind of belt.

Another kind of fabric is the spirally wound fabric having a plurality of spiral coils formed of yarns in a common plane in a side-by-side relationship. The coils extend in a common direction with adjacent coils being intermeshed. The coils are held in intermeshing relationship by a plurality of hinge yarns which extend in a common direction that is perpendicular to the common direction of the spiral coils.

One skilled in the art will recognize that papermachine clothing will be subjected to large quantities of water, varying degrees of relatively high temperatures and numerous chemicals of potentially varying pH. The presence of various dewatering elements, particularly during the forming process, makes the resistance of the clothing to abrasion another important characteristic of the material used since small holes in the fabric can translate into holes in the paper produced in the process. Materials used to form papermachine clothing must possess a balanced mix of useful properties which are often found to be mutually exclusive in polymers.

Papermachine clothing must be structurally/dimensionally stable in the plane of the cloth, flexible in at least the machine direction, and have sufficient tensile modulus in the machine direction to resist stretching. The material used to make the papermachine clothing must possess good knot and loop strength. The materials must also be reasonably resistant to corrosion, absorption of moisture, and hydrolysis. The hot wet environment of the paper making process is conducive to degradation of polymers susceptible to hydrolysis.

There are many materials available to the skilled artisan but very few, if any, offer a good mixture of physical properties and relatively inexpensive pricing. Polypropylene, for instance, is the least expensive material presently available for these applications. It has excellent hydrolytic stability but poor dimensional stability at room temperature and elevated temperatures. As a result, it has only limited use.

Poly(ethylene terephthalate), (PET), is moderately priced, has exceptional dimensional stability and reasonable hydrolytic stability. PET is the predominant material currently used in forming and drying fabrics. In most cases, the hydrolytic stability of PET can be improved to a certain extent by the addition of carboiimide stabilizers.

Abrasive wear experienced by forming fabrics has been further improved by replacing the polyester shute strands with materials with greater abrasion resistance such as a nylon monofilament. However, under such conditions nylons are not dimensionally stable. This results in problems such as edge curl. Thus, there is a trade off between abrasion resistance and dimensional stability.

Hydrolytic stability in dryer fabrics has also been improved through the use of copolymers of 1,4 dimethylcyclohexane, terephthalic acid and isophthalic acid (PCTA). While PCTA is more hydrolytically stable than polyesters, degradation due to hydrolysis still occurs. Alternatives such as PEEK and polyphenylene sulfide offer improved hydrolysis resistance but are considerably more expensive materials.

Nylons have gained favor as the material for constructing press fabrics due to the enhanced levels of abrasion resistance which they exhibit. However, in addition to the trade-off between dimensional stability and abrasion resistance, nylons are condensation polymers and are subject to degradation through hydrolysis. Nylons are also subject to degradation through oxidation.

Polyphenylene sulfide has been used in paper machine clothings. It has excellent dimensional stability and hydrolytic stability but it is relatively expensive, more difficult to work, and tends to suffer from brittle fracture problems in the crystalline state due to normal flexing experienced on the paper machine.

The problems outlined above can be related to fundamental characteristics of the materials considered for use in papermachine clothing applications. Most of the common condensation polymers display a propensity for water pickup and hydrolysis. Thus, retention of mechanical properties such as tenacity and modulus is a problem for such materials. For example, polyamides such as nylon 6,6 tend to lose modulus as it plasticizes in water. It would be desirable to use addition polymers since they are less likely to hydrolyze or lose mechanical properties in the presence of large quantities of water. Unfortunately, common addition polymers have displayed dimensional stability problems. For example, polyethylene and polypropylene are sometimes used in papermachine clothing applications but are not the materials of choice since they possess poor dimensional stability (eg., creep) at use temperatures. When used, these materials are used in warp direction, and alternate with PET yarns, which provide dimensional stability. To date, no addition polymer has been found to be widely useful in papermachine clothing applications.

Polymers of carbon monoxide and ethylenically unsaturated hydrocarbons which are commonly called polyketones are addition polymers which have been known for some time. High molecular weight linear alternating polyketones are of considerable interest because they exhibit a good overall set of physical properties. This class of polymers is disclosed in numerous U.S. patents assigned to Shell Oil Company and is exemplified by U.S. Pat. Nos. 4,880,865 and 4,818,811 which are incorporated herein by reference.

These polymers are relatively high molecular weight materials having established utility as premium thermoplastics in the production of shaped articles such as containers for food and drink and parts for the automotive industry. These articles and applications can be produced by processing the polyketone polymer according to well known methods. The manufacture of polyketone polymer fibers with the mix of properties of particular importance in the fabrication of papermachine clothing has not been heretofore identified.

The paper making art could greatly benefit from the ability to employ an addition polymer with good mechanical properties and high melting temperature as a material for making papermachine clothing.

SUMMARY OF THE INVENTION

Papermachine clothing is made from fibers of linear alternating aliphatic polyketones. The belts have excellent dimensional stability, are hydrolytically stable, and have good resistance to abrasive wear. DETAILED DESCRIPTION It has now been found that linear alternating aliphatic polyketones can be formed into fibers and used as the primary fiber constituent of papermachine clothing. Generally speaking, this invention is practiced by producing fibers comprising linear alternating polyketones and weaving those fibers into papermachine clothing useful in the paper making process. It is particularly desirable to use monofilament fibers of polyketones in this capacity.

The polyketone polymers which are employed in this invention are of a linear alternating structure and contain substantially one molecule of carbon monoxide for each molecule of ethylenically unsaturated hydrocarbon. The preferred polyketone polymers are copolymers of carbon monoxide and ethylene or terpolymers of carbon monoxide, ethylene and a second ethylenically unsaturated hydrocarbon of at least 3 carbon atoms, particularly an a-olefin such as propylene. Such polyketone polymers are aliphatic in that there is an absence of aromatic groups along the polymer backbone. However, linear alternating polyketones may have aromatic groups substituted or added to side chains and yet still be considered linear alternating aliphatic polyketones. Moreover, the polyketones of this invention can be blended with any number of other polymers and then formed into filaments. It will be noted that some blends incorporate the use the aromatic materials and polymers. Nevertheless, the polyketone polymer component is still considered to be of the linear alternating aliphatic type.

When the preferred polyketone terpolymers are employed, there will be within the terpolymer at least about 2 units incorporating a moiety of ethylene for each unit incorporating a moiety of the second hydrocarbon.

Preferably, there will be from about 10 units to about 100 units incorporating a moiety of the second hydrocarbon. The polymer chain of the preferred polyketone polymers is therefore represented by the repeating formula $$-[-CO-(-CH_2-CH_2-)-]_x-[-CO-(-G-)-]_y-$$

where G is the moiety of ethylenically unsaturated hydrocarbon of at least three carbon atoms polymerized through the ethylenic unsaturation and the ratio of y:x is no more than about 0.5. When copolymers of carbon monoxide and ethylene are employed in the compositions of the invention, there will be no second hydrocarbon present and the copolymers are represented by the above formula wherein y is zero. When y is other than zero, i.e. terpolymers are employed, the —CO—(—$CH_2$—$CH_2$—)-units and the —CO—(—G—)- units are found randomly throughout the polymer chain, and preferred ratios of y:x are from about 0.01 to about 0.1. The precise nature of the end groups does not appear to influence the properties of the polymer to any considerable extent so that the polymers are fairly represented by the formula for the polymer chains as depicted above.

Of particular interest are the polyketone polymers of number average molecular weight from about 1000 to about 200,000, particularly those of number average molecular weight from about 20,000 to about 90,000 as determined by gel permeation chromatography. The physical properties of the polymer will depend in part upon the molecular weight, whether the polymer is a copolymer or a terpolymer, and in the case of terpolymers the nature of the proportion of the second hydrocarbon present. Typical melting points for the polymers are from about 175° C. to about 300° C., more typically from about 210° C. to about 270° C. The polymers have a limiting viscosity number (LVN), measured in m-cresol at 60° C. in a standard capillary viscosity measuring device, of from about 0.5 dl/g to about 10 dl/g, more frequently of from about 0.8 dl/g to about 4 dl/g. The backbone chemistry of aliphatic polyketones precludes chain scission by hydrolysis. As a result, they generally exhibit long term maintenance of their property set in a wide variety of aqueous environments. This is in contrast to a material such as nylon 6,6 which suffers the consequences of both hydrolysis and more severe plasticization.

Preferred methods for the production of the polyketone polymers are illustrated by U.S. Pat. Nos. 4,808,699 and 4,868,282 to Van Broekhoven, et. al. which issued on Feb. 28, 1989 and Sep. 19, 1989 respectively and are incorporated herein by reference. U.S. Pat. No. 4,808,699 teaches the production of linear alternating polymers by contacting ethylene and carbon monoxide in the presence of a catalyst comprising a Group VIII metal compound, an anion of a nonhydrohalgenic acid with a pKa less than 6 and a bidentate phosphorous, arsenic or antimony ligand. U.S. Pat. No. 4,868,282 teaches the production of linear random terpolymers by contacting carbon monoxide and ethylene in the presence of one or more hydrocarbons having an olefinically unsaturated group with a similar catalyst.

For the purposes of this specification, the term "fiber" refers to a shaped polymeric body having a high aspect ratio and capable of formation into two or three dimensional articles such as woven or nonwoven fabrics. Fibers can comprise staple, monofilament and multifilament forms. Methods of making such polymeric fabrics are well known in the art.

In a preferred process, polyketone polymer (with additives) in the form of solid pellets are run through a single screw extruder followed by a melt pump for evenly metering out polymer. The polymer is then extruded through a spin pack with a multifilament fiber die to produce fibers. The fibers are sent through a water bath and a series of nips, Godet rollers, and draw ovens where the fiber is drawn under the influence of elevated temperatures. Finally, they may be processed through an annealing oven where they are subjected to heats that are similar to the maximum heat that the fiber is expected to encounter in its use. Annealing takes place without the influence of additional stress and thus may be considered a relaxation step. If one takes the speed differential between first and second Godet roll stand and then adds to that the speed differential between subsequent Godet roll stands they will have the "draw ratio" as it is used in this specification. Continuous polyketone fibers of this invention have been produced using a one inch single screw extruder with an eight hole 0.032 inch die at draw ratios of from 5X to 8X. It is believed that draw ratios in excess of 8X are achievable. The ability to produce fiber at such high draw ratios is largely responsible for the excellent tensile properties seen in the fiber. Nylon 6,6 and polyester can be drawn to between about 5X to a maximum of 6X but are more typically processed at between about 3.5X to about 4X.

Typical ranges of sizes of monofilaments used in forming fabrics are about 0.05 mm to about 0.30 mm in diameter or the equivalent mass in cross-section or in other cross sectional shapes such as squares and ovals. Typical ranges of sizes in press and dryer fabrics are about 0.20 mm–1.27 mm in diameter or equivalent mass in cross section. Some special applications employ fibers having a cross section of up to 3.8 mm.

Once the fiber is formed it is woven into the fabrics used in paper making (papermachine clothing). This can be done according to any of the well known methods currently used in the art of papermachine clothing production. For example, the fabric can be fashioned so that a fiber batt is attached to a support surface extending through the fabric and covering both surfaces. Weave patterns such as twill, modified twill, sateen, and triplex can all be used with polyketone fibers and are among some of the weave patterns known in the art to be useful in such applications.

Any kind of papermaker's fabric or industrial fabric can be constructed of filaments disclosed in the present invention. That is, the filaments of the present invention could be used to construct fabrics used in the forming, pressing, or drying section of a paper making machine. They could be used to construct shoe press belts or paper industry process belts. The material of the present invention could be used in either monofilament or multifilament form. The filaments, when cut into staple fiber, could be used as the batt layer of a press fabric. Fabrics can be formed of a single layer or multilayer construction.

The filaments may comprise the entirety of the fabric, or it may comprise a portion of the fabric, in combination with other materials known to be suited for use in constructing paper machine clothings.

The polyketone of the present invention may be melt blended or compounded with other polymer materials to produce alloy filaments. Suitable polymers which can be blended with polyketone include polyesters such as poly (ethylene terephthalate), poly(butylene terephthalate), copolyesters of terephthalic acid, 1,4-dimethylol cyclohexane, and terephthalic acid, polyamides such as PA6, PA 6,6, PA 6,12, PA 6,10, PA 11, PA 12, PA 12,12, polyetherketones, polypropylene, and polybutylene, fluoropolymers such as poly (tetralfluoroethylene), perfluoroalkoxy, polyvinylidine fluoride, and copolymers of ethylene and tetrafluoroethylene such as those commercially available from DuPont as "TEFZEL" polymer.

The invention is further illustrated by the following non-limiting examples.

EXAMPLE 1

(Polyketone Formation)

A terpolymer of carbon monoxide, ethylene, and propylene was produced in the presence of a catalyst composition formed from palladium acetate, the anion of triflouroacetatic acid and 1,3- bis(diphenylphosphino)-propane. The melting point of the linear terpolymer was 220° C. and it had a limiting viscosity number (LVN) of 1.8 measured at 60° C. in m-cresol.

EXAMPLE 2

(Fiber Formation)

A fiber line was set up with an extruder followed by a gear metering pump to meter polymer to a spinneret, a fiber die, a water bath and a series of nips, three sets of Godet rollers, and three draw ovens. The polymer of example 1 was processed through a one inch single screw extruder using a 3.5 compression ratio polyolefin screw, 0.584 cc/rev melt pump, and 30 hole 0.75 il die with a 7:1 L/D land length.

The extruder had a temperature profile ranging from 221° C. at the hopper throat to 246° C. at the pump. The spinneret was maintained at 246° C. The polymer was used to purge polypropylene in the system for about 30 minutes.

The first temperature of drawing was at 171° C.; the second at 182° C., and the third at 193° C. Four of the thirty ends were strung through the roll stands and taken up on spools. No breaks occurred during the sample collection. An overall draw ratio of 8X was achieved on monofilament collected continuously on a spool.

This examples demonstrates that polyketones can be drawn into the fibers needed for papermachine clothing and that they can be drawn at very high draw ratios. This contributes to their excellent tensile properties.

EXAMPLE 3

(Abrasion Resistance)

Polymer of example 1 was fabricated into 0.20 mm monofilament according to the process of example 2. An overall draw ratio of 5X was obtained. The monofilament was found to have a tenacity of 7.5 gpd, an elongation of 26% and a modulus of 45 gpd.

Abrasion resistance testing of the material was undertaken to determine its specific suitability as a papermachine clothing. A test fabric was made by knitting the material on a FAK laboratory knitter manufactured by Lawson-Hemphill, Spartanburg, S.C. The knitter was equipped with a cylinder containing 8 needles per inch. Each monofilament was knit using a Lawson feeder set at 6.0 inches at circumference with a 4:1 gear ratio. Take-up tension was set at 6 on a scale of 1 to 6 with 6 being the highest tension. After knitting, the fabric was heatset on tenter frames at 150° C. Circular samples of 4.85 inch diameter were cut from each fabric. A Taber 5130 Abraser was used to provide abrasion resistance data. The Abraser was fitted with HI 8 standardized abrasion wheels and 250 gram loadings. Abrasion duration was set at 500 cycles and conducted with no vacuum. All samples were soaked in water for 15 minutes and loaded onto the Abraser with the loop side exposed to the wheels. All samples were abraded while wet to mimic conditions on a papermachine. Abrasion was calculated as weight loss on the dry starting fabric sample and its resultant abraded state after removal of abraded material and ambient drying of fabric for two hours. Five tests were run, the average polyketone weight loss was found to be 0.0226 grams (with a standard deviation of less than one sd unit; ie, 95% confidence level).

EXAMPLE 4

(Abrasion Resistance-Comparative)

A polyester shute material (S-90W PET produced by Albany International)was subjected to the abrasion testing protocol of example 3. Identical testing conditions were employed. Five tests were run. The PET samples were found to have an average weight loss of 0.0434 grams (with the difference between means being significant at the 95% confidence level).

Comparing example 3 and example 4 it can be seen that papermachine clothing comprised of polyketone materials is more resistant to abrasion than papermachine clothing comprised of the most widely used polyester materials.

EXAMPLE 5

(Dimensional Stability)

Dimensional stability testing was conducted on polyketone monofilament and other monofilaments used in papermachine clothing. Polymer of example 1 was fabricated into 0.20 mm monofilament according to the process of example 2. An overall draw ratio of 8X was obtained. The monofilament was found to have a tenacity of 12.9 gpd, an elongation of 10% and a modulus of 140 gpd. Comparative samples were comprised of a polyester warp material ("Wl 10" brand polyester commercially available from Albany International), a polypropylene material ("0.20P3-B" brand polypropylene commercially available from Albany International) and a polyamide 6 material ("AIX- 101 " produced by Albany International).

All of the samples had a starting diameter of 0.20 mm. Both wet and dry samples were prepared. Dry samples were initially 150 cm in length and were loaded with a tension of 1.0 gpd. Wet samples were initially 100 cm in length and were loaded with a tension of 1.1 gpd when immersed. Creep was measured in length change in centimeters. Table 1 summarizes the results.

TABLE 1

| Polymer | Length Change (cm) | | | | | | | |
|---|---|---|---|---|---|---|---|---|
| Condition: Time (mins) | Poly-ketone dry | Poly-ketone wet | PET dry | PET wet | PP dry | PP wet | PA6 dry | PAG wet |
| 3 | 1.0 | 0.4 | 1.50 | 0.8 | 4.6 | 4.8 | 10.0 | 7.3 |
| 10 | 1.0 | 0.6 | 1.6 | 0.8 | 5.1 | 5.5 | 10.4 | 7.3 |
| 30 | 1.1 | 0.6 | 1.7 | 1.1 | 5.5 | 5.8 | 10.6 | 7.7 |
| 100 | 1.3 | 0.6 | 2.1 | 1.2 | 6.4 | 6.4 | 10.9 | 8.0 |
| 300 | 1.3 | 0.7 | 2.1 | 1.2 | 6.8 | 7.2 | 11.1 | 8.1 |
| 1400 | 1.3 | 0.7 | 2.1 | 1.3 | 8.0 | 8.2 | 11.4 | 8.3 |
| 3000 | 1.3 | 0.8 | 2.2 | 1.3 | 8.2 | 8.7 | 11.5 | 8.5 |
| 10020 | 1.3 | 0.9 | 2.3 | 1.5 | 9.4 | 9.5 | 11.8 | 8.6 |
| 20100 | 1.4 | 0.9 | 2.3 | 1.5 | 10.0 | 9.7 | 11.8 | 8.6 |
| 30200 | 1.4 | 0.9 | 2.3 | 1.5 | 10.1 | 10.3 | 11.9 | 8.6 |

This example illustrates that papermachine clothing comprised of polyketone has superior ability relative to the polyamides, polypropylene, and polyesters.

EXAMPLE 6

(Knot and Loop Retention)

Polymer of example 1 was fabricated into 0.20 mm monofilament according to the process of example 2. One fiber was drawn at a draw ratio of 5X and the other at a draw ratio of 8X. The fibers were tested for knot and loop retention according to ASTM D3217.

The fiber drawn at a draw ratio of 5X had a knot retention of 76% and a loop retention of 64%. The fiber drawn at a draw ratio of 8X had a knot retention of 22% and a loop retention of 9%.

EXAMPLE 7

(Hydrolytic Stability)

Polyketone polymer of Example 1 and Nylon 6,6 were exposed to various aqueous solutions at 80° C. for 25 days. Yield stress values for each of the polymers was determined for each of the polymers in each of the solutions (tensile testing was conducted at 23° C.). The results are shown in Table 2.

TABLE 2

| Chemical | Aliphatic Polyketone (MPa) | Polyamide 66 (MPa) |
|---|---|---|
| Control (50% rh) | 57.9 | 57.2 |
| Water | 59.2 | 33.1 |
| 5 wt % Acetic Acid | 57.9 | 33.8 |
| 5 wt % Calcium Chloride | 60.0 | 33.8 |

This example illustrates the excellent dry to wet stability of polyketones relative to condensation polymers. After exposure to aqueous environments, the yield stress of the polyamide was about 40% below that of the polyketone.

EXAMPLE 8

(Hydrolysis Resistance)

The tensile properties of a polyketone monofilament (0.20 mm diameter), were determined with an Instron tester (10' gap between jaws, 10' minimum crosshead speed, 72° F., 55% relative humidity):

| | |
|---|---|
| Tenacity | 9.1 gpd |
| Break Load | 7.82 lb. |
| Strain (at 2 gpd) | 2.91% |
| Break Strain | 12% |
| Modulus | 87.5% |
| Denier | 390 |

The dry to wet resistance of the monofilaments was assessed by exposing the monofilaments to steam at 250° F. at 15 psi for several days. For comparative purposes, monofilaments of poly(ethylene terephthalate) containing 1% (w/w) monomeric carbodiimide stabilizer were exposed to the same environment. Hydrolysis resistance was assessed as a measure of retained break load over a period of several days:

| | Retained Break Load % | |
|---|---|---|
| Exposure Time (days) | Polyketone | Stabilized PET |
| 3 | 100 | 97.4 |
| 7 | 93 | 94.2 |
| 10 | 97 | 89.8 |
| 12 | 107 | 55 |
| 14 | 108 | 0 |

EXAMPLE 9

(Chemical Resistance)

Polyketone monofilaments as described in Example 8 were exposed to various chemicals in order to assess chemical resistance. The monofilaments were exposed for a 10 day period and chemical resistance was assessed by measuring retained break load at the end of the period.

| Chemical | Retained Break Load (%) |
|---|---|
| 5% Sulfuric acid | 100 |
| 5% Aluminum sulfate | 100 |
| 5% Sodium Hydroxide | 100 |

The foregoing examples illustrate that papermachine clothing comprised of aliphatic polyketones display strength, dimensional stability, and hydrolytic stability that represent a substantial improvement over fibers of the prior art.

We claim as our invention:

1. Papermachine clothing comprised of melt spun fibers of an addition polymer of carbon monoxide and at least one ethylenically unsaturated hydrocarbons wherein said polymer is an alternating aliphatic polyketone.

2. The papermachine clothing of claim 1 comprising a forming fabric.

3. The papermachine clothing of claim 1 comprising a press fabric.

4. The papermachine clothing of claim 1 comprising a dryer fabric.

5. The papermachine clothing of claim 1 comprising a paper industry process belt.

6. The papermachine clothing of claim 1 comprising a shoe press belt.

7. The papermachine clothing of claim 1 comprised of filaments which are woven.

8. The papermachine clothing of claim 1 comprised of filaments which are non-woven.

9. The papermachine clothing of claim 1 wherein the papermachine clothing is further comprised of at least two layers of fabric.

10. The papermachine clothing of claim 1 comprised of filaments attached to the papermachine clothing as a batt layer.

11. The papermachine clothing of claim 1 comprised of monofilament fiber.

12. The papermachine clothing of claim 1 comprised of multifilament fiber.

13. The papermachine clothing of claim 1 comprised of fiber having a round cross-section.

14. The papermachine clothing of claim 1 comprised of fiber having an elliptical cross-section.

15. The papermachine clothing of claim 4 comprised of fiber having a rectangular cross-section.

16. The papermachine clothing of claim 1 comprised of spirally wound fabric.

* * * * *